US005471775A

United States Patent [19]

Hoyt et al.

[11] Patent Number: 5,471,775

[45] Date of Patent: Dec. 5, 1995

[54] OUTDOOR PULL-DOWN DISPLAY SIGN FOR USE WITH EXISTING OUTDOOR SIGNS

[76] Inventors: Wilber S. Hoyt, 406 Beverly Dr., Lafayette, La. 70503; William S. Thornton, 204 Ella St., Lafayette, La. 70506

[21] Appl. No.: 167,340

[22] Filed: Dec. 16, 1993

Related U.S. Application Data

[63] Continuation of Ser. No. 905,337, Jun. 29, 1992, abandoned.

[51] Int. Cl.[6] ..... G09F 9/00

[52] U.S. Cl. ..... 40/601; 40/617; 40/624

[58] Field of Search ..... 40/601, 602, 617, 40/624; 187/407

[56] References Cited

U.S. PATENT DOCUMENTS

| | | | |
|---|---|---|---|
| 1,072,799 | 9/1913 | Wall | 40/601 |
| 2,515,978 | 7/1950 | Bauers | 40/601 |
| 2,522,157 | 9/1950 | Bauers et al. | 40/601 |
| 2,591,494 | 4/1952 | Asachika | 40/601 |
| 3,609,898 | 10/1971 | Brown | 40/601 |
| 3,673,720 | 7/1972 | Thornton | 40/601 |
| 4,411,084 | 10/1983 | Kraus | 40/601 |
| 4,829,688 | 5/1989 | Mouraret et al. | 40/601 |

FOREIGN PATENT DOCUMENTS

| | | | |
|---|---|---|---|
| 322302 | 6/1989 | European Pat. Off. | 40/601 |
| 14881 | of 1910 | United Kingdom | 40/601 |

*Primary Examiner*—Kenneth J. Dorner
*Assistant Examiner*—Cassandra Davis
*Attorney, Agent, or Firm*—Dowell & Dowell

[57] ABSTRACT

An outdoor pull-down signboard is provided which is adaptable to existing sign support columns by being mounted above and in-front-of the existing signs and in some cases utilizes the reader board panels extracted from the existing signs. A frame for retaining and rapidly replacing picture panels covers all or a portion of the signboards face and further provides a transparent panel covering a reader board portion is also provided.

15 Claims, 11 Drawing Sheets

OUTDOOR PULL-DOWN DISPLAY SIGN FOR USE WITH EXISTING OUTDOOR SIGNS

This is a continuation of U.S. Ser. No. 07/905,337 filed Jun. 29, 1992, now abandoned, and entitled, Telescoping Traversing Changeable Message Sign.

BACKGROUND OF THE INVENTION

1. Field of the Invention

This invention relates to large display signs in general and more particular to commercial display signs which must be changed frequently due to menu or price changes.

2. General Background

Fast food outlets, service stations, quick stop type stores and other such businesses generally display their specialties and prices with large display signs along the street adjacent their place of business. As menus and prices fluctuate these signs must be changed repeatedly, often placing personnel at risk and requiring excessive amount of time and labor. Various means have been employed to accomplish this process. Reader boards as they are called are used, whereby the price numbers or letters are positioned in grooves by someone standing on a ladder. To prevent accidents, devices which allow the sign to be lowered to ground level while the display is changed and then raised to its normal display height have been developed. Examples of such signs can be had by reviewing U.S. Pat. Nos. 2,215,978, 1,072,799, 2,522,157, 2,591,494 and 4,829,688. Inevitably these methods create as many problems as they solve. If the numbers and letters are placed in groves, they are subject to high winds blowing them out, often tearing them apart requiring replacement. If the sign is fixed, personnel are placed at risk by standing on high ladders. If the sign is lowered to ground level for changing, special winch systems are usually employed along with a guide system to restrain the sign from swinging while being lowered. This is usually a result of such signs being heavily constructed. The process of lowering such signs often requires two or more people to accomplish the task. Therefore, a need exist which addresses both the problem of efficiency and economy.

To replace such signage is expensive and a waste of materials. In some cases it may be advantageous to retain access to the reader board portion of the sign whereby price changes can be made while changing or retaining a picture panel portion of the sign.

It is therefore an object of the present invention to provide a system which allows a single person to simply pull down a light weight sign panel, replace the picture face panel with an economical laminated paper poster by snapping the poster into a secure clamp type frame and returning the sign to its display position in a very short period of time.

It is another object of the invention to provide an inexpensive laminated picture display sign panel for such signs. It is still another object of the invention to provide a pull-down sign system which can be retrofitted to an existing fixed sign structures.

A further object of the invention is to provide a sign having quick change replaceable picture panels in combination with a reader board portion.

SUMMARY OF THE PRESENT INVENTION

The present invention discloses an apparatus for achieving the above objectives. In general, the present invention provides an outdoor pull-down signboard and support frame adaptable to existing vertical sign columns capable of retrofit over existing signs. Thereby making the invention universal in nature. In this manner the invention can take advantage of almost any sign column or utilize the existing signage to maximize its strategic advantage at a minimum cost. The frame work when fitted to an existing column provides a housing for receivable retaining a pair of rectangular frames flexibly suspended therefrom. This allows the invention to be attached to columns which already have signs higher up on the column. The picture frames are backed up by hollow core boxes having reader board channels, designed to allow for interchanging large numbers and letters, and which usually houses the sign's back lighting system. The suspended picture frame its readerboard and core box is bracketed to the support column in a latched manner. The frame work can also be attached to columns in a manner whereby the suspended picture frames and core boxes are placed over the existing sign bodies. In which case, the picture frames and core boxes utilize the reader board panel from the existing signs. In either case counter weights attached to the suspended frames through a system of pulleys provide a quick and easy method of lowering and raising the light weight hollow core frames. In one embodiment the laminated picture panel, comprised of a core box and a hinged frame, includes a plexiglass cover sheet and a picture paper covering all or a portion of the face panel captured between the frame and the core box. In a second embodiment the hinged frame and plexiglass cover sheet are replaced by a snap frame which allows access to a laminated picture paper. In both cases a reader board type plastic panel is utilized, preferably from an existing sign if possible, as a backing panel in the core box. Thus a potion of the reader board can be left exposed for price changes. The picture frames allow the pictures to be changes without disturbing the reader board. The plexiglass further provides protection from wind damage to the numbers used on the reader board. To change the display one need only unlatch the suspended frame from the lower column bracket or sign body with a special extendable retracting handle while standing on the ground. Then using the special retracting handle pull the frame to ground level, release the hinged tubular frame or snap open the frame clamps replace the laminated picture paper, snap the frames closed, raise the sign frame to its original counter balanced position and relock the frame to the column or existing sign body. This simple process is made possible due to the suspended frame's light weight, counter balance system, single column support which can assist the operator in controlling the sign, the inexpensive quick change laminated display papers and the quick clamp type frames which hold the display papers in a secure manner.

BRIEF DESCRIPTION OF THE DRAWINGS

The invention and its advantages may be better understood from the exemplary embodiments which are given below as non-limiting indications and which are illustrated by the accompanying drawings, wherein.

DETAILED DESCRIPTION OF THE PREFERRED EMBODIMENT

Figure 1:
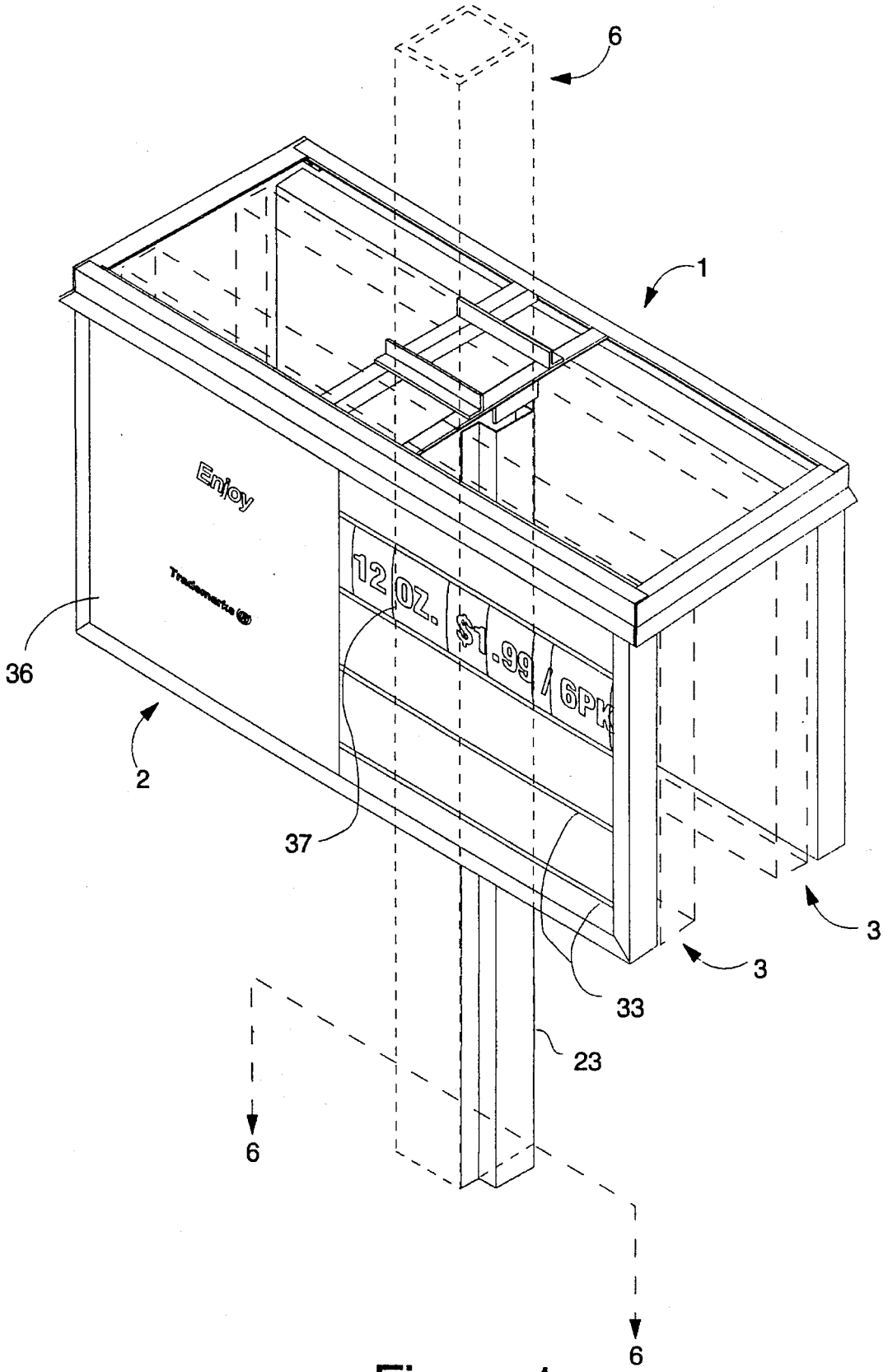
FIG. 1 is an isometric view of the framework and suspended frames as it would be attached to a vertical column.
Figure 2:
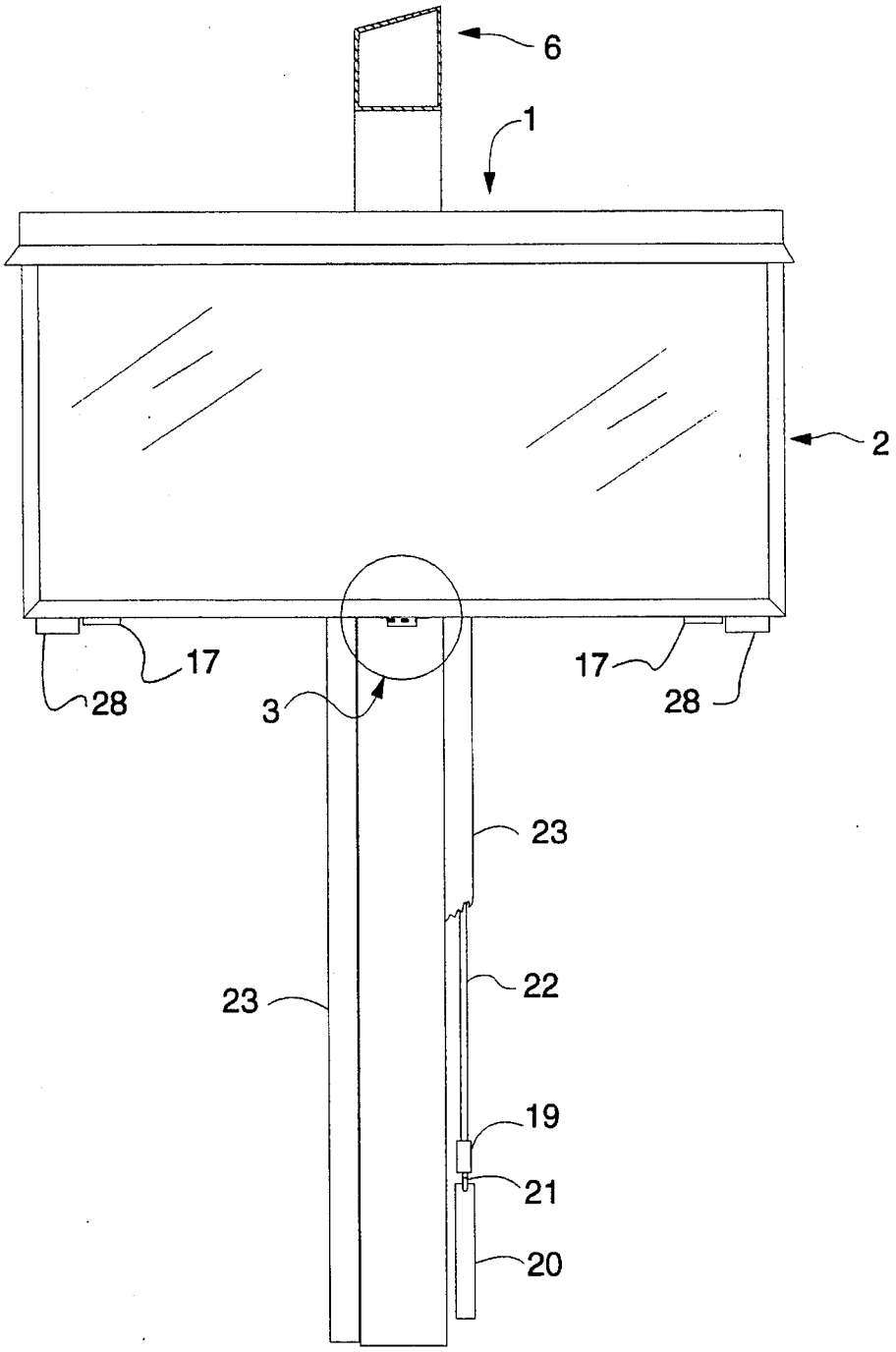
FIG. 2 is a vertical elevation of the invention attached to an vertical column.
Figure 3:
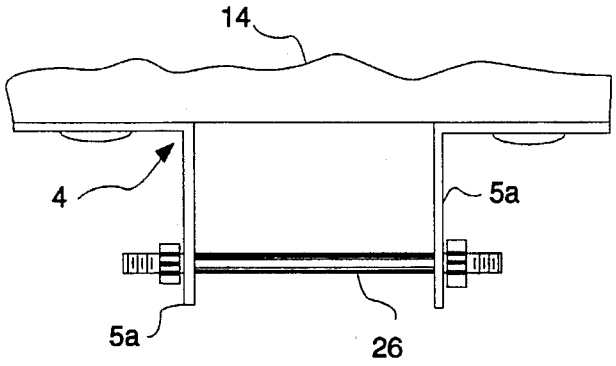
FIG. 3 is a partial view of the pull-down handle located on the bottom of the suspended core box, FIG. 4 and 4(*a*) show partial isometric views of the upper and lower portions of the extendable pull-down tool.
Figure 4:
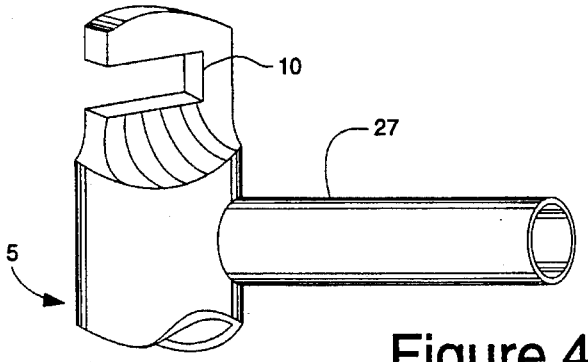
Figure 4A:
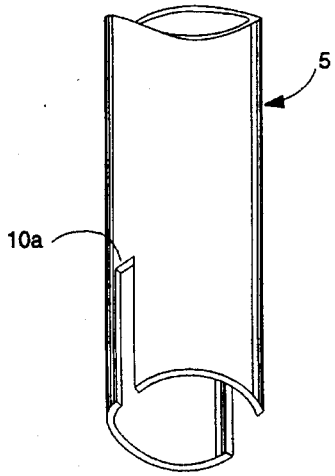
Figure 5:
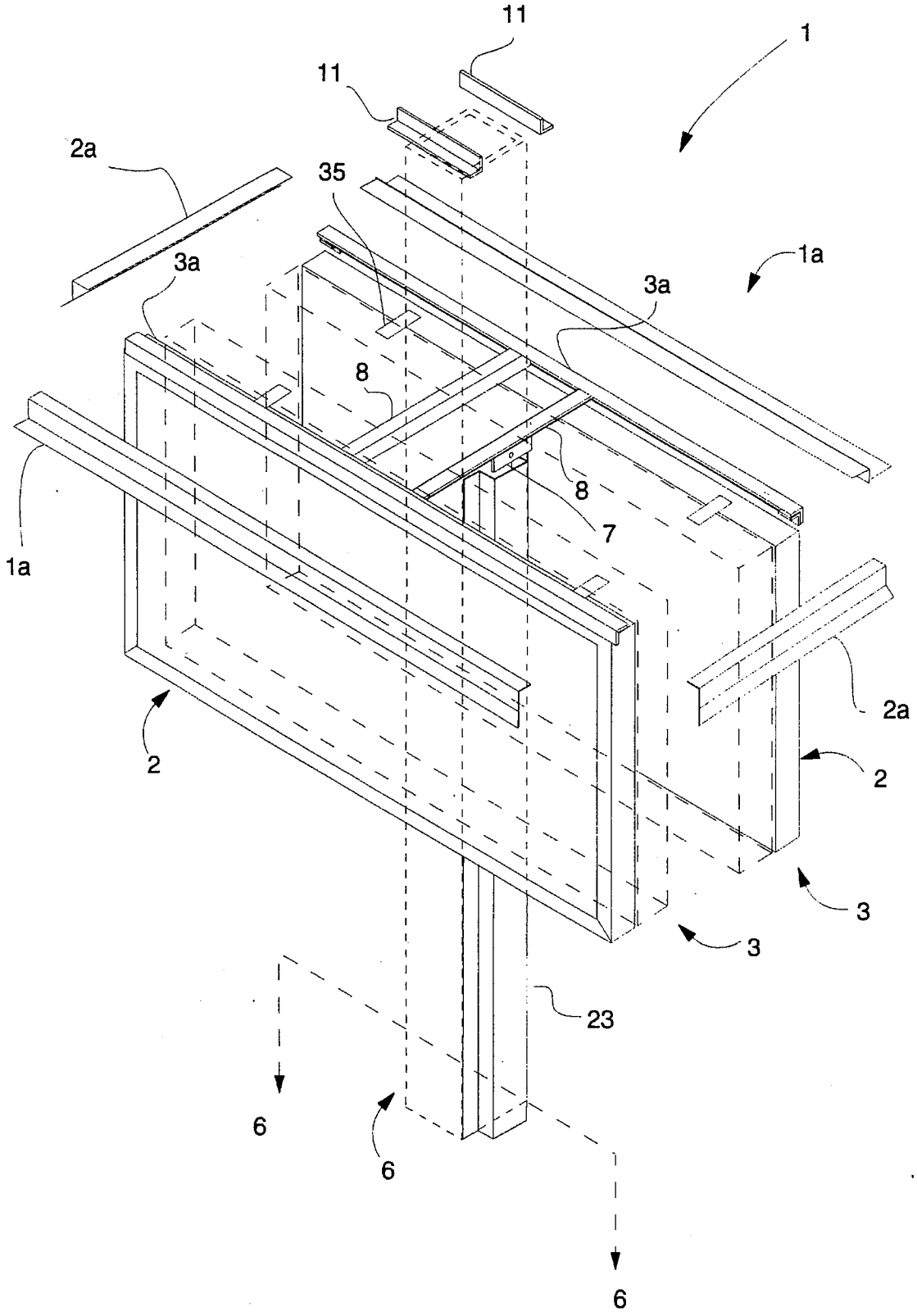
FIG. 5 is and exploded view of the frame work which attaches to the vertical column and houses the spendable frames.
Figure 6:
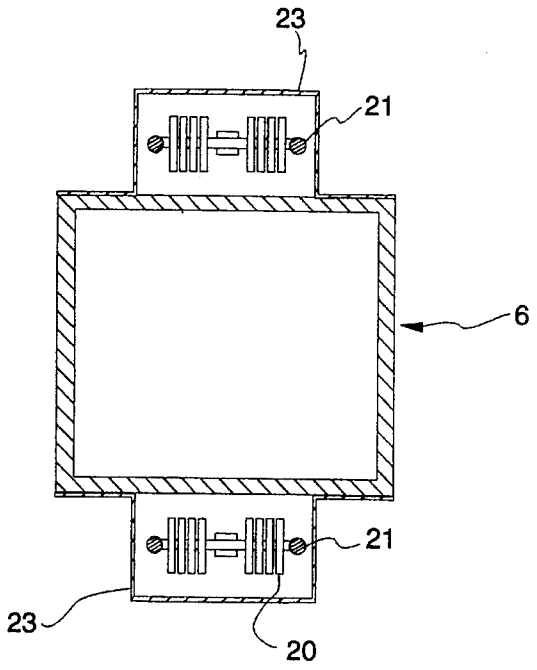
FIG. 6 is a cross section view of the vertical column taken along sight line 6—6 in FIG. 1 showing the weights, support cables and cover plates.
Figure 7:
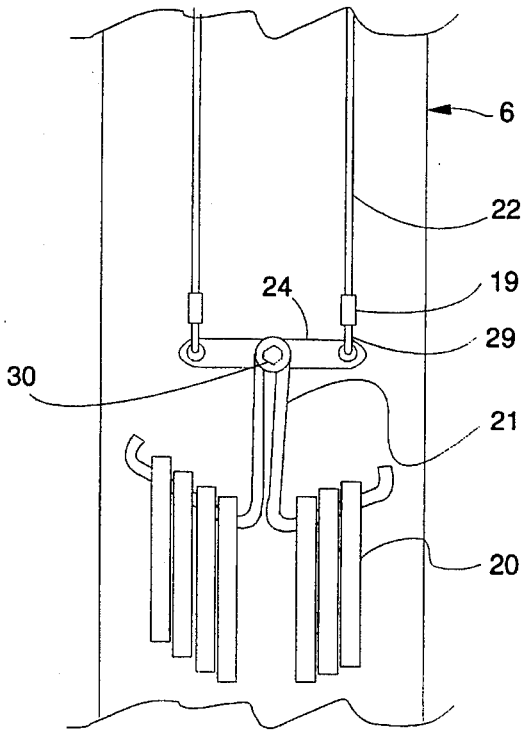
FIG. 7 is a partial view showing one set of counter weights and their suspension means.
Figure 8:
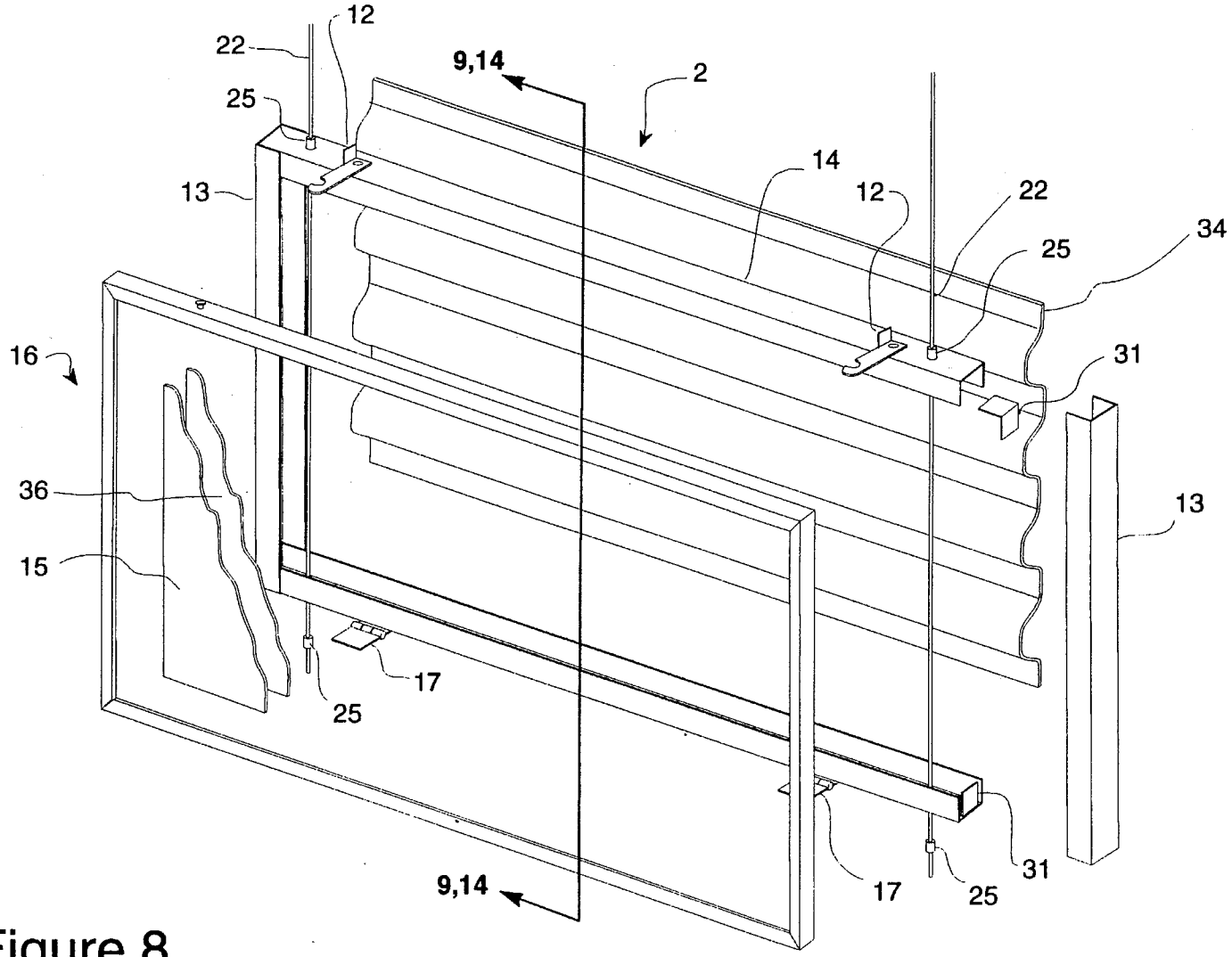
FIG. 8 is an exploded view of one embodiment showing the suspended frame and the core box.
Figure 12:
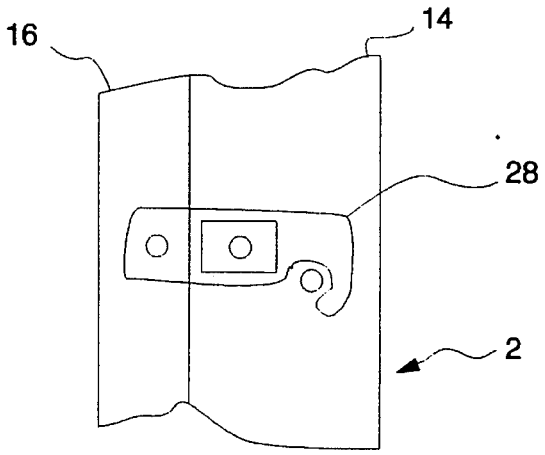
FIG. 12 is a partial representation of the lower latch apparatus used to latch the suspended frame to the frame or existing sign body.
Figure 13:
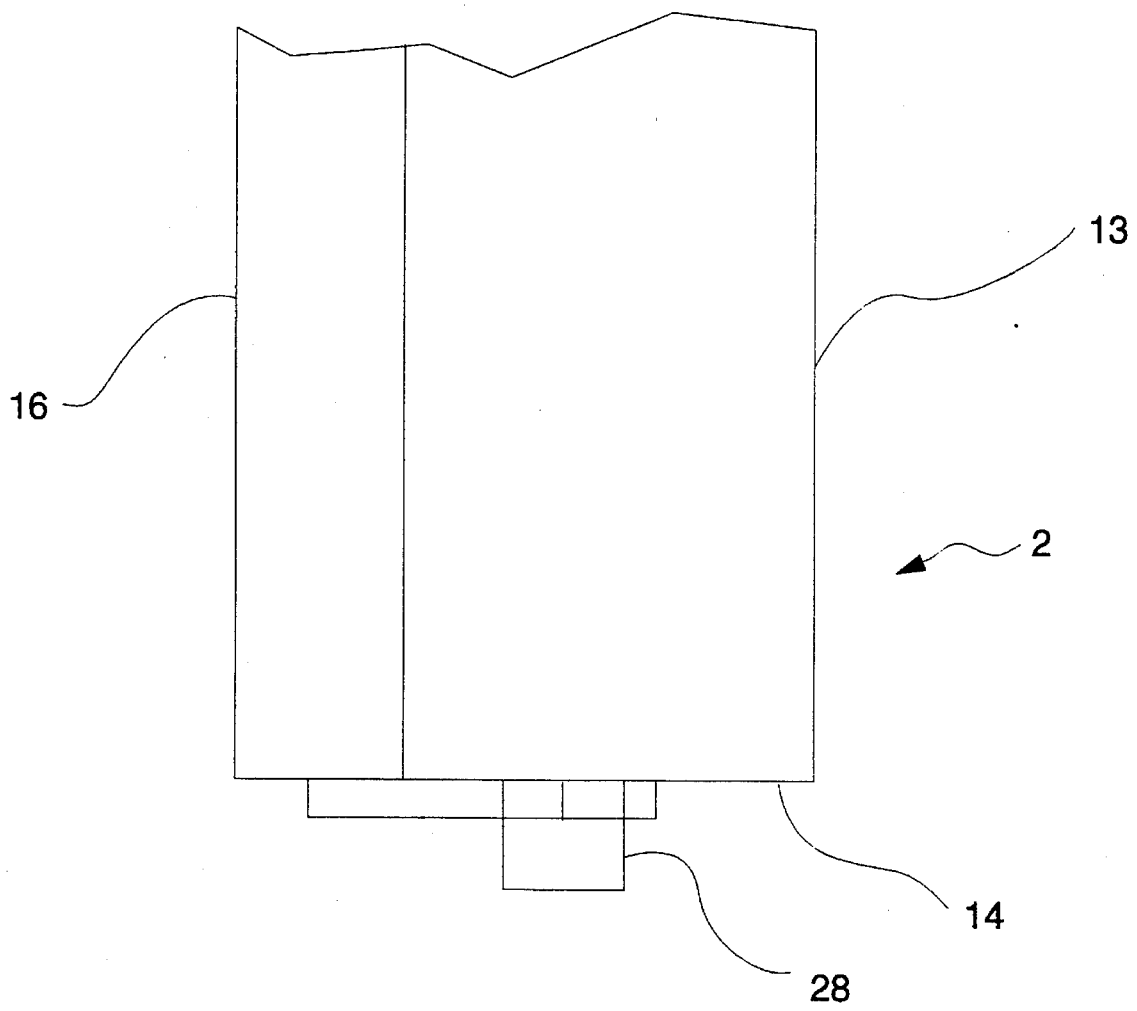
FIG. 13 is a partial side elevation of the latch shown in FIG. 12.
Figure 15:
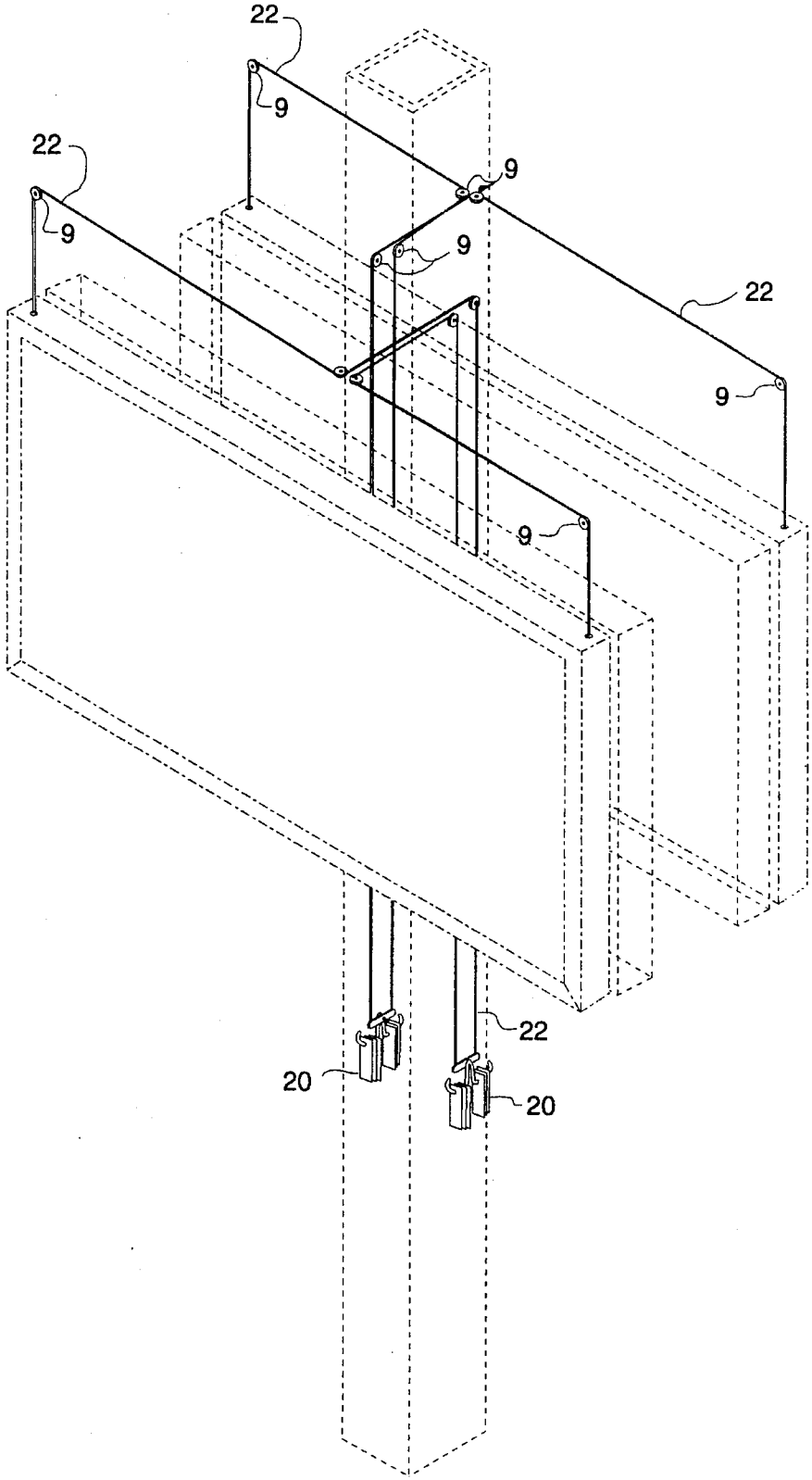
FIG. 15 is an isometric arrangement view of the counter weight pulley and cable runs.

Looking first at FIG. 1 we see a signboard 2 canopy or frame assembly 1 for attachment to an existing outdoor display sign vertical support column 6. Structural framing 8 & 11 as seen in FIG. 5 can be adapted to fit any vertical sign support column configuration and additional brackets can be added to accommodate hearer loads. The signboard 2 arrangement can also be adapted to fit over large existing outdoor display signs 3 or be used alone above of below such existing signs. The pull-down signboard 2 face panel may be either a picture 36 covering the full sign face or a combination of partial picture and changeable numbers or letters 37 positioned in channels 33, either of which can be readily changed easily from ground level. The face of the pull-down signboard 2 can be overlaid by a transparent cover sheet 15 thereby preventing wind damage. Turning now to FIG. 2 we can see the base of the pull-down signboard 2 panels are equipped with handles 26, latches 28, and in some cases hinges 17. A set of counter weights 20 positioned inside a cable channel 23 running along either side of the pull-down sign's 2 column 6 provide a method of lowering the pull-down signboard 2 to ground level. As best seen in FIG. 3 only one person is required to release the latches 28 (detailed in FIG. 12 & 13) by engaging the latch 28 with the slot portion of pull-down tool shown in FIG. 4 & 4*a* and rotating the tool with the torque handle 27. To pull the pull-down signboard 2 to ground level the pull-down tool is then reversed, thus by engaging the signboard's handle 26 with the tool's jaw 10 as seen in FIG. 4, the pull-down sign 2 can then be easily pulled to ground level due to the pull-down sign's counter weights 20. A set of facia panels 1*a*, 2*a*, are provided to cover the upper portion of the signboard's 2 structural frame 3*a*, and to help weather proof the new signboards 2. The counter balance system comprising a set of cables 22 and pulleys 9 arranged as shown in FIG. 15 and further detailed in FIGS. 6 & 7 provides a simple adjustable method for balancing the pull-down signboards's weight. The cables 22 pass through the pull-down signboard's 2 core box upper and lower members 14, secured on each side of the pull-down signboard 2 by cable clamps 25, then threaded through a system of pulleys 9 and brackets 7 terminating via cable loop 29 and sleeve 19 at a pivot bar 24 located inside channels 23 running down the column 6. The pulleys 9 and cables 22 shown in FIG. 15 are attached to support angles 3*a* and pulley brackets 7 respectively, not shown in FIG. 15 for clarity. A counter weight hanger 21 is pivotally attached to a pivot pin 30 centrally positioned in the pivot bar 24. Thereby allowing the counter weights 20 to react evenly on both cables 22 attached to each end of the pull down signboard 2 as seen in FIG. 8. A pair of stop brackets 35 attached to the top of the existing signs 3 as illustrated in FIG. 5 serve as stops for maintaining horizontal alignment with the existing sign.

Figure 9:
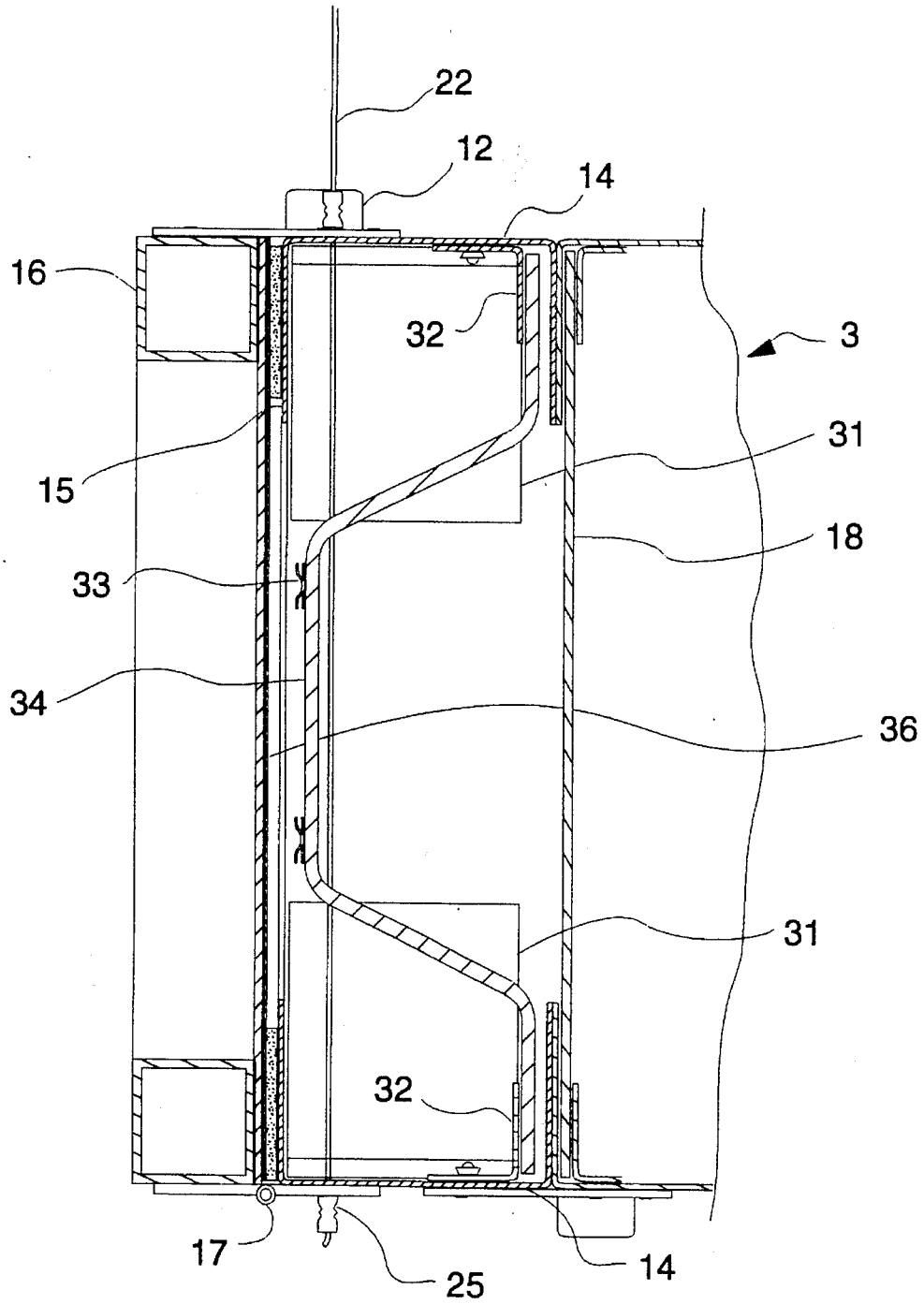
FIG. 9 is a partial cross section view of taken along sight line 9—9 in FIG. 8.
Figure 10:
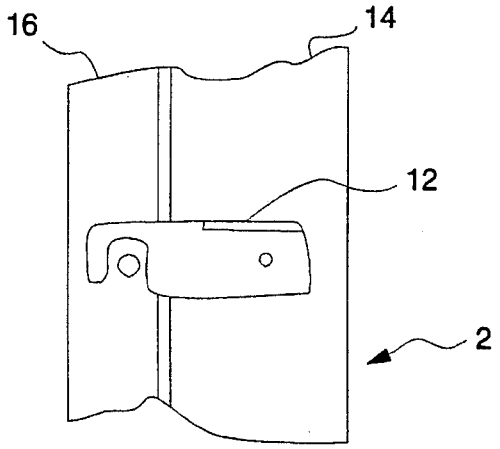
FIG. 10 is a partial representation of the top latching apparatus used to lock the suspended frame to the box.
Figure 11:
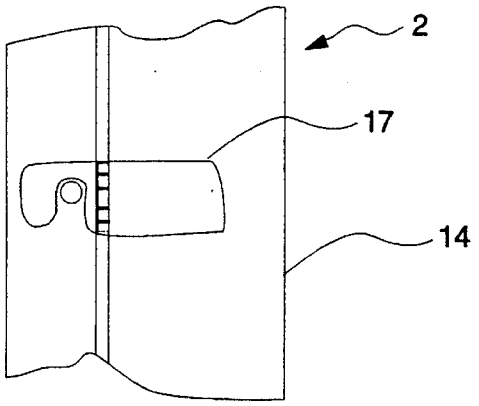
FIG. 11 is partial representation of the lower latch apparatus used to lock the suspended frame to the box.

One embodiment detailed in FIG. 9 illustrates the signboard's core box comprised of a generally rectangular frame having upper and lower formed channel frame members 14 and end caps 13, attached together with corner clips 31. The pull-down signboard's core box is then fitted with a corrugated reader board panel 34, secured in place by plastic clips 32, having channels for attaching numbers and letters 37. A box perimeter frame 16 is attached to the face of the core box by hinges 17 shown in FIG. 11 located along the edge of the lower box member 14 and secured in position at the top box member by a latch 12 as shown in FIG. 10. A picture paper 36 and a protective transparent plastic sheet is captured and held securely between the core box and the perimeter frame 16, thereby protecting the numbers or letters 37 held in the reader board plastic panel 34.

Figure 14:
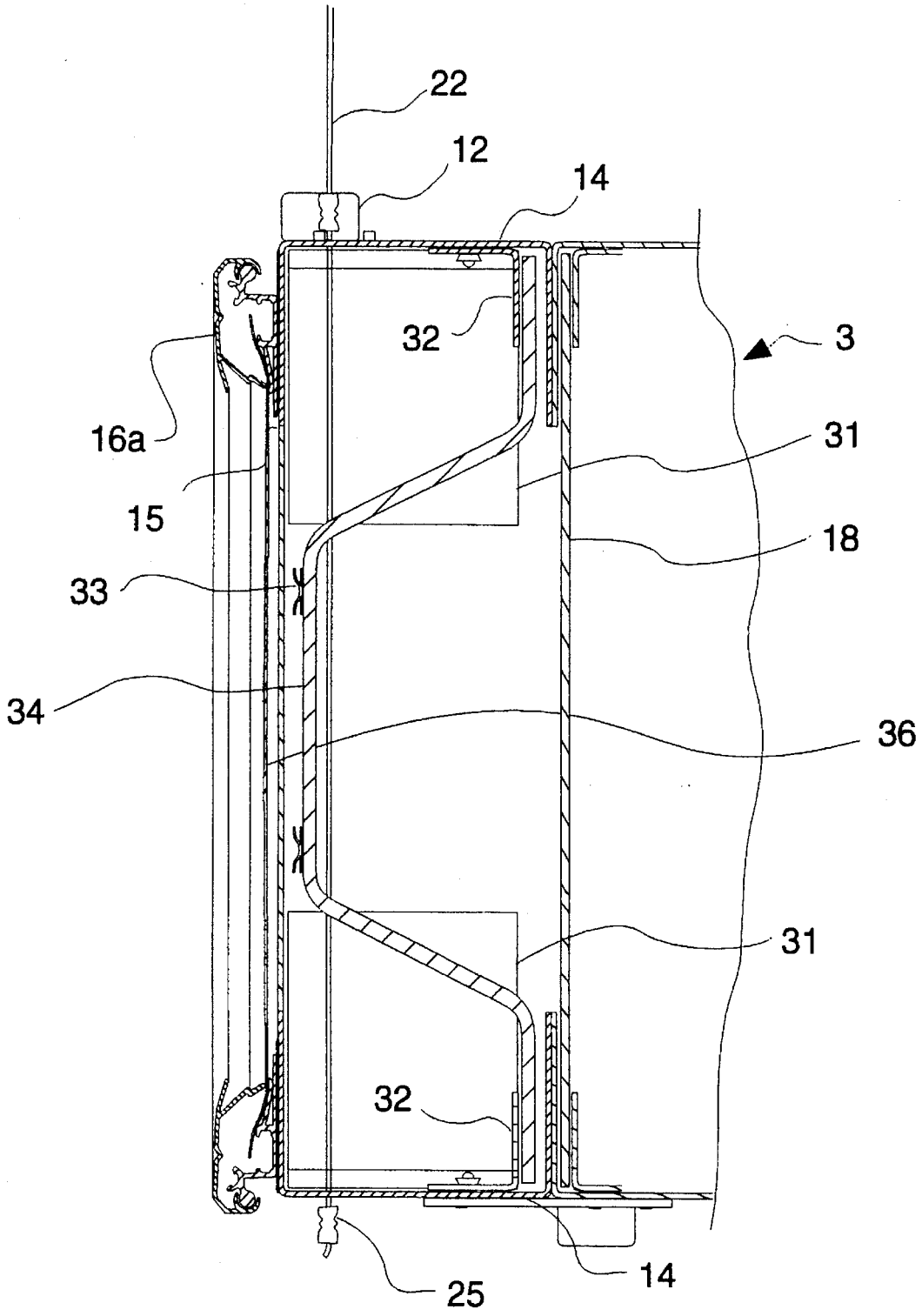
FIG. 14 is a cross section view taken along the sight line 14—14 in FIG. 8 showing a second embodiment with the snap clamps attached directly to the box thereby eliminating the tubular frame.

A second embodiment, as seen in FIG. 14, can be provided which replaces the box perimeter frame 16, shown in FIG. 9, with a spring loaded snap type frame 16(a). Thus eliminating the need for hinges 17 or latches 12. A laminated picture paper 36 can be provide which replaces the transparent plastic sheet 15. Such a laminated picture 36 need not cover the full sign face and can be partially transparent. Thus the picture could cover a portion of the pull-down sign's face while still covering numbers or letters 37 mounted in the reader board's channels 33. If the existing signs 3 have reader boards 34 which can be adapted for use when the pull-down signboard 2 is suspended over them, a transparent sealing panel 18 is then provided as replacement for sealing the existing sign 3, thus allowing the existing sign 3 to provide back lighting for the new pull-down signboards.

List of terms:

1. canopy frame assembly
1*a*. front facia
2. pull-down sign assembly
2*a*. side facia
3. existing reader board
3*a*. support angles
4. handle assembly
5. pull down tool
5*a*. handle bracket
6. existing sign column
7. cable pulley bracket plastic panel
8. cross members
9. pulleys 36.
10. handle tool jaw
10*a*. handle tool latch slot letters
11. optional support angles
12. top latch
13. pull-down frame end cap 14. pull-down frame upper and lower members
15. plexiglass panel
16. hinged perimeter frame assembly
16a. optional snap frame assembly
17. lower hinge
18. optional acrylic seal for existing sign
19. cable loop sleeve
20. counter weights
21. counter weight hanger
22. cable
23. cable channel
24. pivot bar
25. cable clamp
26. pull-down handle bar
27. tool torque handle
28. lower latch
29. thimbles
30. hanger pivot pin
31. corner angle clips
32. plastic clips
33. reader board channels
34. existing reader board plastic panel
35. stop bracket
36. laminated picture
37. replaceable numbers and letters

What is claimed is:

1. An outdoor pull-down display sign adapted to be mounted juxtaposed to an existing fixed outdoor advertising sign mounted on a vertical support comprising:

a. a support frame;

b. means for adaptably attaching said support frame to a vertical sign support;

c. at least one signboard core box, flexible means for suspending said at least one signboard core box from said support frame, said at least one signboard core box including upper and lower channel members connected by end cap members, a corrugated panel located between said upper and lower channel members having channels along one face for holding sign members and letters;

d. latching means for latchably securing said signboard core box relative to an existing outdoor advertising sign;

e. counter-balance means for reciprocally raising and lowering said at least one signboard core box from ground level to said support frame, said counter-balance means attached to said flexible means; and f. securing means for releasably securing a display advertising panel to said at least one signboard core box.

2. The outdoor pull-down display sign of claim 1 wherein said latching means is adapted to secure said at least one signboard core box to an existing fixed outdoor advertising sign.

3. The outdoor pull-down display sign of claim 1 wherein said latching means is adapted to latch said at least one signboard core box to a vertical support.

4. The outdoor pull-down display sign of claim 1 wherein said securing means is hinged to said at least one said signboard core box.

5. The outdoor pull-down display sign of claim 1 wherein said securing means is a biased snap type frame.

6. The outdoor pull-down display sign of claim 1 wherein said securing means is a hinged perimeter frame.

7. The outdoor pull-down display of claim 6 wherein said display advertising panel is laminated.

8. The outdoor pull-down display sign of claim 6 wherein said at least one signboard core box further comprises a transparent plastic sheet placed between said perimeter frame and said display advertising panel.

9. The outdoor pull-down display sign of claim 6 wherein said display advertising panel covers only a portion of said corrugated panel.

10. The outdoor pull-down display sign of claim 1 wherein said flexible means and said counter-balancing means further comprise:

a. a set of support cables, piercing said at least one signboard core box near each such end and secured thereto by cable clamps;

b. a plurality of pulleys mounted to said support frame for directing said cables to each side of said support frame;

c. a pivot bar attached to said cables opposite said at least one signboard core box;

d. a pivot pin centrally located in said pivot bar;

e. a counter-weight hangar pivotally attached to said pivot pin; and f. counter-weights suspended from said counter-weight hangar.

11. An outdoor pull-down display sign adapted to be superimposed over an existing fixed outdoor advertising sign mounted on a vertical support comprising:

a. a support frame for attachment to the vertical support;

b. at least one signboard core box;

c. a latching means for latching said at least one signboard core box relative to the vertical support;

d. a counter-balance means for reciprocally raising and lowering said at least one signboard core box from ground level to said support frame, said counter-balance means including flexible suspension means movably guided relative to said support frame and supporting said at least one signboard core box;

e. channel means for attachment to the vertical support housing said counter-balance means; and f. means for aligning said at least one signboard core box adapted to be aligned with and superimposed externally over an existing fixed outdoor advertising sign.

12. An outdoor pull-down display sign according to claim 11 wherein said latching means is adapted to releasable latch said at least one signboard core box to an existing fixed outdoor advertising sign.

13. An outdoor pull-down display sign according to claim 11 wherein said at least one signboard core box comprises:

a. a first rectangular frame;

b. a plastic corrugated panel, having means for holding numbers and letters interposed within said first rectangular frame;

c. a second rectangular frame hinged to said first rectangular frame; and d. a handle means for grasping said first rectangular frame.

14. An outdoor pull-down display sign according to claim 13 wherein said flexible suspension means and said counter-balancing means further comprise:

a. a set of cables attached to said at least one signboard core box;

b. a plurality of pulleys attached to said support frame for threadably receiving said cables;

c. a pivot bar, attached to said cables opposite said at least one signboard core box;

d. a pivot pin, centrally located in said pivot bar;

e. a counter-weight hangar, pivotally attached to said pivot pin; and f. a plurality of counter-weights suspended from said hangar.

15. An outdoor pull-down advertising display sign adapted to be used with an existing vertical sign support juxtaposed to an existing outdoor advertising display sign comprising, a fixed frame adapted to be mounted to an existing vertical sign support above an existing outdoor advertising display sign, at least one pull-down signboard having upper and lower portions and including thereon changeable character display means for receiving letters and numbers, flexible means suspended from said fixed frame, said at least one pull-down signboard being adapted to be aligned with and superimposed externally over an existing outdoor advertising display sign, latch means mounted to said lower portion of said at least one pull-down signboard adapted to releasably retain said at least one pull-down signboard in juxtaposed parallel alignment to an existing outdoor advertising display sign, said at least one pull-down signboard being vertically adjustable between said fixed frame and a lower character display changing position, and counter-balance means secured to said flexible means to allow for ease of lowering of said at least one pull-down signboard, and said character display means being retained by a perimeter frame attached to said at least one pull-down signboard.

* * * * *